United States Patent [19]

Clayton

[11] 4,216,249

[45] Aug. 5, 1980

[54] METHOD AND MEANS FOR COATING THE INTERIOR OF A VERTICALLY DISPOSED ELONGATE HOLLOW MEMBER

[75] Inventor: Donald W. Clayton, Lafayette, La.

[73] Assignee: Champion Chemicals, Inc., Houston, Tex.

[21] Appl. No.: 840,831

[22] Filed: Oct. 11, 1977

[51] Int. Cl.[2] ..... B05D 7/22

[52] U.S. Cl. ..... 427/230; 15/162; 118/254; 118/DIG. 10; 166/244 C

[58] Field of Search ..... 118/254; 427/DIG. 10, 427/23 D, 239; 15/162; 116/244 C

[56] References Cited

U.S. PATENT DOCUMENTS

| | | | |
|---|---|---|---|
| 221,939 | 11/1879 | Root | 118/DIG. 10 |
| 1,746,071 | 2/1930 | Cotton | 118/DIG. 10 |
| 1,787,126 | 12/1930 | Steinnes | 118/DIG. 10 |
| 1,796,337 | 3/1931 | Moore | 118/DIG. 10 |
| 1,796,338 | 3/1931 | Moore | 118/DIG. 10 |
| 1,799,385 | 4/1931 | Moore | 118/DIG. 10 |
| 3,079,888 | 3/1963 | McClean | 118/DIG. 10 |
| 3,105,554 | 10/1963 | McCall | 118/DIG. 10 |

FOREIGN PATENT DOCUMENTS

| | | | |
|---|---|---|---|
| 8193 | 7/1879 | Fed. Rep. of Germany | 118/254 |

*Primary Examiner*—Sam Silverberg

[57] ABSTRACT

The method involves injecting into the hollow member adjacent its upper end a body of the material for coating the interior of the member, and then forcing the body of coating material downwardly while forcing an annular portion of the material laterally outwardly into engagement with the walls of the hollow member. This is done by a brush having bristles facing outwardly and of sufficient flexibility to enable them to pass through a stricture of a predetermined degree in the hollow member and to expand when not in such strictures so that at all times the bristles are in close proximity to the inner surface of the hollow member and spread the coating material therealong, pushing the extra coating material ahead to subsequently coat lower portions of the interior of the hollow member. Part of the coating material will escape past the brush to the space thereabove, and when the brush reaches the lower extremity of the hollow member it will be retracted to coat the interior of the hollow member a second time upon upward movement of the brush to the upper end to the hollow member. The means for coating include a brush assembly made up of one or more brushes sized and constructed as above stated, disposed singly or one above the other in multiple, and having a weight connected thereto above or below the brush or brushes, of sufficient density and small enough cross section so that the brush assembly as a whole will move downwardly through the hollow member at a rate greater than would the material for coating the hollow member under the force of gravity alone. Means is provided for retracting the brush assembly after the downward coating trip.

4 Claims, 4 Drawing Figures

METHOD AND MEANS FOR COATING THE INTERIOR OF A VERTICALLY DISPOSED ELONGATE HOLLOW MEMBER

BACKGROUND OF THE INVENTION

1. Field of the Invention

This invention relates to the interior coating of an elongate hollow member substantially vertically disposed or at least having a substantial vertical component of its longitudinal dimension. An example of such a member is a pipe or tubing disposed in a well in the earth in which event the coating material employed would be likely to be some protective coating or anticorrosive material. Such material is normally a liquid but is more or less viscous and is of a character which tends to cling to the walls of the pipe or tubing and form a slug therein. It is also important that the entire interior of the pipe or tubing be coated because any spots or streaks or other portions not coated are likely to be even more subject to corrosive influences than if the pipe as a whole were not coated.

Where the coating operation is to be carried on in a well which is producing gas on the like it is important that the production be not interrupted any longer than absolutely necessary. Hence it is important to minimize the time required for coating the pipe in the well as well as to insure its complete coating.

2. Description of the Prior Art

Various means have been employed for coating the inside of a pipe in a well with anticorrosive chemicals or with other substances found desirable in any particular case, but perhaps the most commonly used is the method whereby a body of liquid anticorrosive chemical estimated to be sufficient to coat the inside of the pipe in question is injected into the upper end thereof and allowed to fall by gravity to the lower end.

This method involves a number of non-desirable features:

1. The interior surface coverage is likely to be incomplete. In practice the rather viscous liquid tends to flow down one side of the pipe and adhere thereto as it flows instead of moving down as a complete plug or as a sheet of liquid completely covering the interior surface of the pipe.

2. The liquid flowing over the surface of the pipe may not completely wet the entire surface of the pipe but may, after flowing past, withdraw from the surface of the pipe leaving it uncoated in spots.

3. Particularly where the well is on an inclination to the vertical there is a strong tendency for the liquid to run down the lower side of the tubing or pipe and coat that side only, leaving the upper side of the interior of the pipe uncoated.

4. Contrary to what might be expected, the movement of chemical downwardly within a tubular member such as a well tubing is very slow as a rule. The chemical seems to be inclined to form a piston within the tubing and move downwardly at a pace of perhaps not more than 1,000 feet per hour, or a little over 16 feet a minute, requiring for deep wells from 12 to 24 hours for the chemical to move from top to bottom. This of course is highly undesirable in requiring an extremely long well shut down time.

No representation is made that the method above described is the only one employed for the purpose, but it is believed to be the most widely used and to be the most satisfactory prior to the present invention, as evidenced by its wide use.

SUMMARY Of THE INVENTION

It is an object of this invention to provide a method for coating the inside of a hollow member such as a tubing or other pipe in a well in the earth, which method will result in a much more perfect job of complete coverage and intimate contact of the coating material with walls of the member and which may be much more rapidly carried out than the presently conventional method of providing such coating.

It is also an object to provide a device capable of carrying out the method above mentioned, which will be simple and effective and will avoid any problems likely to be countered in operating such a device in a well.

In particular it is an object that such device be capable of moving through a hollow member both through portions which may be slightly larger then nominal, and through portions which may be restricted, the means being so constructed as to expand and contract to some degree to accomodate for such variations in size, and thereby to apply a consistently continuous coating of material over the entire inner wall of a hollow member regardless of the presence of enlargements or strictures.

Another object is to provide such a means which is unlikely to become stuck in strictures or small places in a hollow member.

Another object is to provide such a means which may be run on a flexible cable or wire line and which may be jarred or bumped in order to dislodge it if it should become somewhat wedged in a stricture or the like.

Another object of this invention is to provide such a means which will be moved downwardly through a well at a much faster rate than that at which a liquid coating material can be moved through the well by gravity alone. It should be able to do this even in the presence of the rather viscous liquid material. The movement should be fast enough so that, for example, a 10,000 foot well, instead of requiring from 12 to 24 hours to treat as with current procedures, could be treated in a time of the order of 2 hours.

In accordance with this invention the body of coating material would be injected as with the current method so as to inject into the upper end of the hollow member a sufficient body of coating material to coat the entire interior of the member. However, beginning immediately after the injection of the coating material into the hollow member, instead of waiting for it to fall by gravity and run down the walls of the member to coat them, a brush or brushes will be injected into the upper end of the hollow member and forced downwardly to force the coating material downwardly in the hollow member at a much more rapid rate then such material would move by itself. The device for doing this would consist of one or more bristle type brushes having bristles of such a character that they would bend and permit the brush to go through a somewhat strictured portion of the hollow member, but then resume their original shape so as to brush the interior walls of the full intended cross section of the hollow member. In case of the use of multiple such brushes, they would be employed in tandem and interconnected with each other by flexible joints which might be termed knuckle joints. On the lower end of the brush, or on the lower-most of the brushes, if there be more than one, is preferably a device known as a "Go-No Go" member which is essentially a gage sized to pass through the smallest opening which the brushes will pass through without likelihood of becoming stuck. Carried preferably but not necessarily above the entire brush assembly would be a weight, preferably of a high density material so that as much weight as possible could be concentrated in a small body as possible, and this weight would be of a cross sectional area much smaller than the interior of the hollow member so as to permit it to fall readily through the body of liquid or other coating material through which the brush assembly is intended to be forced downwardly in the course of the coating operation. The downward forcing of the coating material in this fashion causes a small portion of the material to be squeezed between the brushes and the inner wall of the hollow member so as to brush such material well into the walls of the hollow member. Some of the coating material will squeeze past or extrude into the space above the brush assembly as the brush assembly moves downward. Then when the brush assembly reaches its lowermost position and starts up the material on top of the brush assembly will be moved into the space between the brushes and the inner wall of the hollow member so as to again brush such material onto such walls.

In order to readily move the brush assembly upwardly in the well and complete the process the uppermost of the brushes is equipped with a means to receive a wireline or cable by which the brush assembly may be pulled upwardly.

The brushes also are preferably slidably mounted on mandrel sections, one mandrel section for each brush, so that if by chance one of the brushes did become wedged or stuck in the course of the operation, it will be possible to lower the mandrel assembly with the brush remaining in its tight position, and then to pull upwardly sharply on the mandrel assembly causing it to hammer against the brush and tend to dislocate it from its stuck position.

Referring now to the drawings, there is illustrated a certain preferred embodiment of the invention. It will be understood that this is for the purpose of illustration and example only and not by way of limitation.

DESCRIPTION OF THE PREFERRED EMBODIMENT

Figure 1:
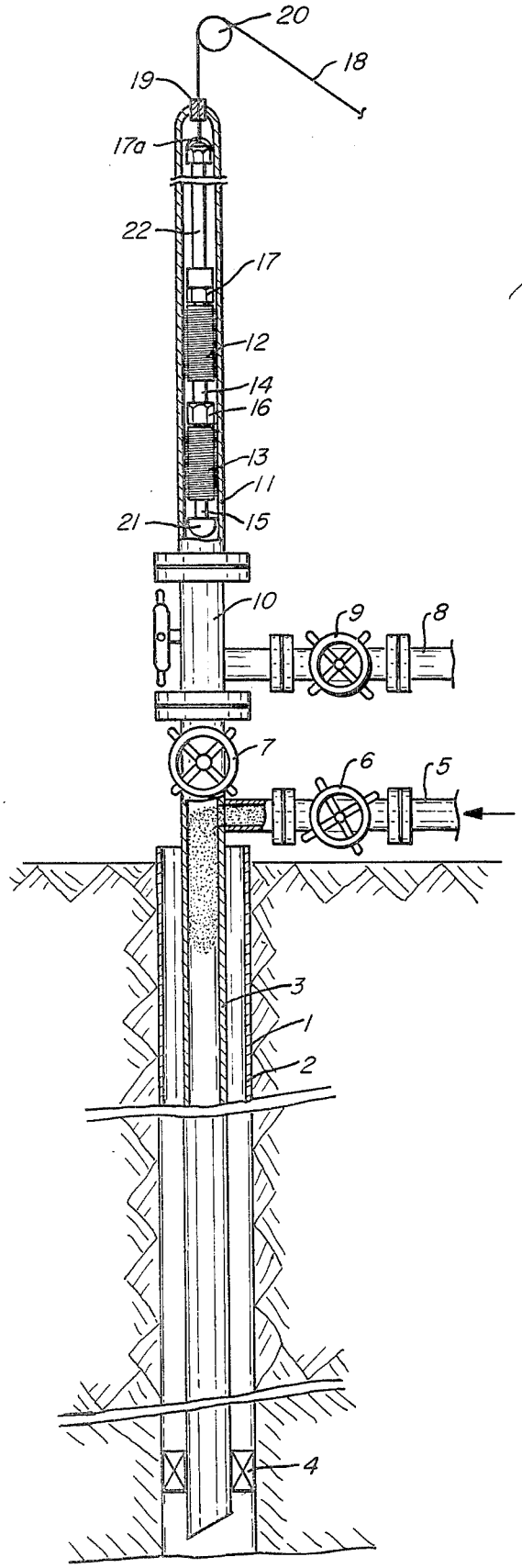
FIG. 1 is a view in longitudinal cross section with parts shown in elevation and the other parts broken away for purposes of illustration, showing a well at the beginning of the performance of the method of this invention.

The method of the invention has to do with the coating of the inside of a hollow elongated member such as a tubing or the like in a well in the earth, with the member having a substantial vertical component of its longitudinal disposition. That is, it not necessarily a member with its longitudinal component exactly vertical but is intended especially for such a member with its longitudinal component having a substantial vertical extent. Neither is it limited to a tubing in a well, but is applicable to other elongated hollow members to the interior of which a substance such as a corrosion inhibitor should be applied so as to substantially coat its entire inner surface.

The specific embodiment to be described will be one having special application to a tubing in a well, usually a gas well, and to the application to the inner surface of such tubing for the purpose of completely coating it, of a liquid or substantially liquid corrosion inhibiting chemical.

Such a set up is illustrated in FIGS. 1, 2, 3, and 4 of the drawings, these figures being designed to illustrate different steps in the carrying out of the method.

Referring more specifically to the drawings, a well 1 has disposed therein a casing 2 and within the casing is a production tubing 3, the lower end of the production tubing being customarily packed off to the interior of the casing 2 by means of a packer 4.

It will be understood that the upper end of the casing 2 is also normally closed by a casing head or the like with suitable arrangements for forming a seal between the upper end of the casing and the outer wall of the tubing 3. This has been omitted from the present drawings for the purpose of simplifying the illustration as it is not essential to the illustration of the present invention.

The upper end of the tubing would normally be connected to at least one lateral flow line 5 through a valve 6. It might also be connected upwardly through a valve 7 with a lateral flow line 8 controlled, in its turn, by a valve 9. A fitting 10 could serve as a connection for this lateral flow line 8, and valve 9 and, in turn, could receive an upward extending chamber 11, normally called a lubricator.

In the more conventional and usual way of coating the inside of a tubing 3 located in a well as illustrated, a body of the coating material would be injected through the line 5 and valve 6 while the valve 7 would remain closed, or in some other convenient fashion would be injected into the upper end of the tubing. The quantity employed would of course be calculated to be sufficient to coat the entire inside of the tubing from the top to the bottom.

Normally the coating material so injected would be liquid having some viscosity but capable of readily wetting the walls of the tubing and hence of coating them as the body of coating material moves through the tubing toward the bottom thereof.

Conventionally it is allowed to fall by gravity until it reaches the bottom of the tubing.

This method has been used rather extensively, but it has certain marked problems which the present invention overcomes. Among these is that the downward movement through the tubing is comparatively very slow, such as of the order of 1,000 feet per hour. Further, it tends to form a stream down one side of the tubing leaving the other side uncoated, and there is no way of controlling the thickness of the coating and hence the amount of chemical that might be used nor of making the coating of anything like a uniform thickness. Hence in order to insure a complete job more chemical than actually necessary to provide a uniform coating would normally be required.

In accordance with this invention, before the injection of the body of chemical, a lubricator 11 would be connected to the upper end of the well and would have placed therein a brush assembly including one or more brushes such as brushes 12 and 13. Each brush would be mounted on a mandrel such as the mandrels 14 and 15, each such mandrel being of greater length than the length of the brush, and securing the brushes with a slidable engagement so that they might each slide up and down on the mandrel on which they are mounted. The two mandrels would be joined by appropriate connection 16 between their adjacent ends, it being preferred that the connection 16 be capable of universal movement such as commonly referred to as a knuckle joint.

The upper end of the upper mandrel has a suitable connection thereon at 17 which serves as a stop for downward movement of the mandrel through the brush 12. A means 17*a* is provided for connecting to the upper end of the assembly a wire line or cable 18 by which the mandrel may be manipulated upward and downward in the well. Between the connection 17 and the cable connector 17*a* is a weight 22 described more in detail below.

The upper end of the lubricator is provided with a stuffing box 19 through which the wire line 18 runs. The wire line 18 may be conveniently run over a pulley at 20 and downwardly to a suitable hoisting equipment of conventional character.

On the lower end of the lower mandrel 15 there is preferably provided a stop member 21 designed to limit the upward movement of the mandrel 15 through the brush 13. This stop member 21 is preferably also designed to act as a "Go-No Go" to guard against the possibility of the brush assembly being moved into a section of tubing that is of too small an internal dimension and thus to get stuck in the tubing. The stop member 21 for this purpose would be made of an outer dimension at least as great as the minimum dimension through which the brush assembly is designed to move without getting stuck. Thereby if the brush assembly should be moved downwardly into engagement with a stricture in the tubing which has an inner dimension smaller than that through which the brush assembly is designed to move without sticking, the member 21 would engage such stricture and stop movement of the brush assembly. The brush assembly could then be removed without being stuck.

The purpose of the brush assembly just described is to be moved downwardly within the tubing at a much faster rate then the liquid coating material would move by itself under the force of gravity and hence to overcome the sluggishness of the more or less viscous liquid coating material. It also performs other functions of equal or greater importance as will be presently stated.

In order to move the brush assembly downward in the tubing at such a substantially greater rate than the liquid by itself would move, there is secured to one end, preferably the upper end of the brush assembly a long and relatively slender weight 22, preferably of much greater density than the liquid coating material and of a maximum cross section dimension such that its downward movement will be restricted by the least possible amount.

By contrast with the relatively slow rate of fall of the chemical alone in the well tubing, it has been found possible to move a brush assembly of the character described downwardly in the tubing at a rate of 95 to 200 feet per minute, or some 6 to 12 times as fast as the fall rate of the chemical alone. Thus by the method of this invention there has been accomplished the surprising result of greatly increasing the rate of downward movement of chemical coating material into the tubing, cutting of the time for coating a tubing to something like 1/5 to 1/12th of that previously required.

Furthermore, as the brush assembly is pushed downwardly by its weighted upper or lower end against the body of coating material in the tubing, and moved downwardly against such coating material at a more rapid rate than that at which the coating material would move by the action of gravity alone, some of the coating material will be forced into the space between the body of each of the brushes and the inner wall of the tubing, and as the brush moves downwardly will be brushed upon the inner wall of the tubing throughout the entire 360° of its interior surface. This results both in the assurance that the entire inner surface is being coated and in the maintainence of some degree of uniformity of the thickness of coating on the inner wall of the tubing. Additionally, excessive material is pushed ahead of the brush assembly to a lower level where it continues to act in the same way to coat the lower portions of the tubing. Some of the coating material will move past the brush assembly into the space within the tubing above the brush assembly and will follow it down.

When the brush assembly reaches its lowest extent of its travel in the tubing, namely the lower end of the portion of the tubing which is to be coated, it should have used up that portion of the coating material which will have been precalculated to cover the length of tubing to be treated, with a quantity left over which in the process of downward movement will have extruded past the brush assembly and be located on top of it.

At this point the brush assembly may be retrieved by means of the wire line 18 and pulled back upwardly through the tubing into the lubricator. In this process the body of coating material above the brush assembly is again moved outwardly into the space between the brushes and the interior of the tubing and the brushes provide a second coating sweep so as to cover any possible gaps left in the original coating action.

As soon as the brush assembly is moved upwardly into the lubricator 11, the valve 7 may be closed and the flow line 5 opened by means of the valve 6 whereupon the well may be put into production. The lubricator 11 may be then removed and the brush assembly taken off and disassembled or transported to another job.

For illustration attention is directed to FIGS. 1, 2, 3, and 4 of the drawing as showing the different stages of the coating operation. In FIG. 1 the brush assembly is still in the lubricator 11 whereas the body of coating material is shown within the upper end of the tubing where it tends initially at least to form a piston of liquid.

Figure 2:
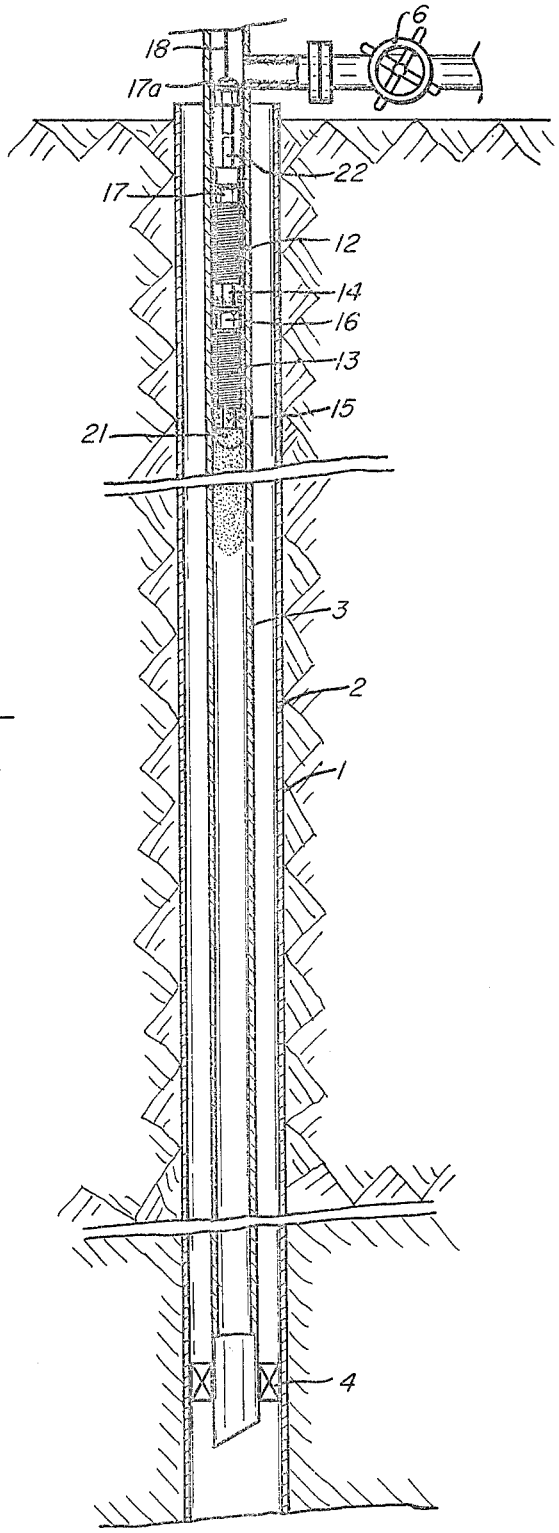
FIG. 2 is a similar view of a portion of the well shown in FIG. 1 just after the brush assembly has started its downward trip into the well coating the inner walls of the well tubing as it goes.
Figure 3:
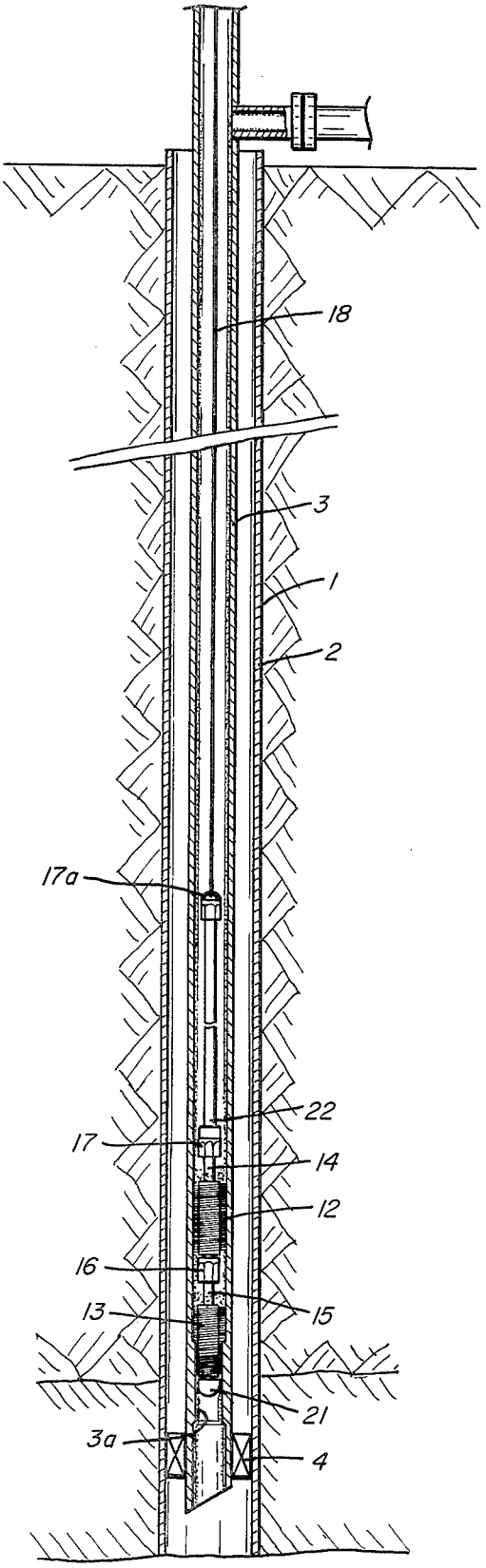
FIG. 3 is a view similar to FIG. 2 but showing the brush assembly substantially at its lower most position and moving upwardly, with one of the brushes passing through a restriction such as a landing nipple.

Next, with the valve 6 closed and valve 7 opened, the brush assembly will be lowered on top of the coating material body and started down the well as illustrated in FIG. 2. It is contemplated that during this downward passage a practically complete coating job will be accomplished, with the upward passage involved in removing the brush assembly being relied on for insuring that the coating job leaves no uncoated parts of the interior of the tubing. In FIG. 3 the brush assembly is shown passing through a restriction such as a landing nipple in the tubing. In such case the bristles of the brush will fold back against the surface of the brush body so that the brush may pass through an opening if it is as large as the outer diameter of the body plus twice the bristle thickness. In this Figure the brush assembly is shown near but above the lower end of the tubing, the entire tubing having been coated on its inner surface and the brush assembly having started upward, with a small body of coating material on top of the brush assembly.

Figure 4:
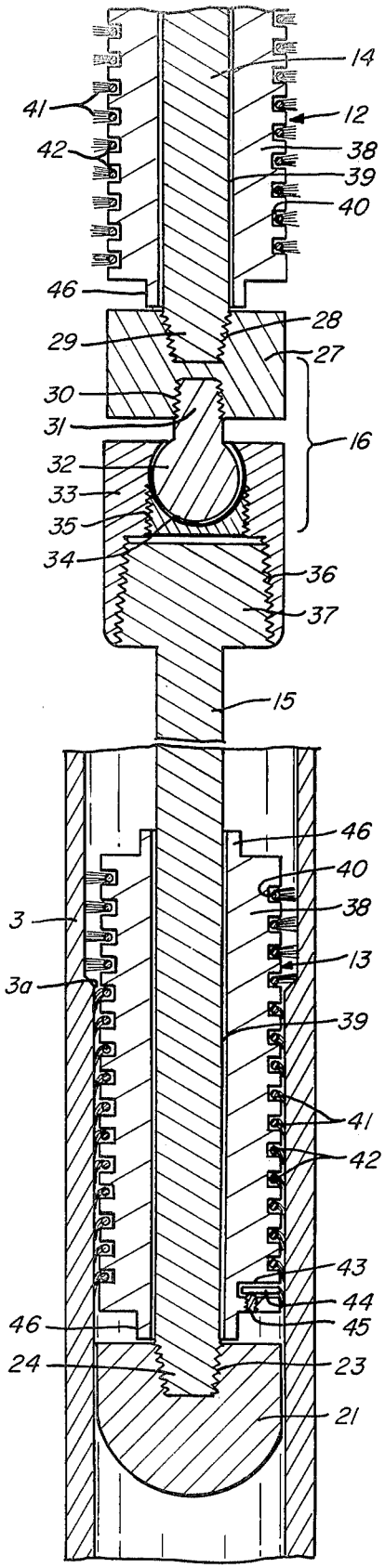
FIG. 4 is an enlarged cross section of a portion of the brush assembly showing the brush construction and the mounting of the same on the mandrels together with the means of interconnecting the brushes of the assembly and of the action and mounting the "Go-No Go" and the weight on the brush assembly, and further showing the action of the bristles when in and when not in a restriction.

In FIG. 4 more detail is shown of the preferred apparatus for carrying out the method above described. Here it is apparent that the mandrels 14 and 15 are both longer than the bodies of the brushes so that the brushes may be moved upwardly and downwardly along the respective mandrels. The lower end 24 of the lower mandrel 15 is shown as being threaded at 23 to be received in a corresponding threaded socket in the "Go-No Go" member 21.

The knuckle joint 16 has an upper portion 27 threaded at 28 to the lower end 29 of the upper mandrel 14, and has a second threaded socket in its lower extremity at 30 to receive the threaded upper end 31 of a ball section 32.

The lower element 33 of the knuckle joint 16 is adapted to receive the ball element 32 and has a restriction in its opening at its upper end to retain such ball against movement upwardly from the member 33. Member 33 may be inserted into this position through an opening 34 from the lower end of the member 33, the walls 35 of this opening being of great enough dimension to permit the passage of the ball 32.

The lower portion of the knuckle joint element 33 has a relatively large threaded socket 36 therein to receive the threaded head member 37 on the upper end of the mandrel 15. Thus, it will be seen that when the parts are assembled as illustrated in FIG. 4, the upper and lower mandrels may be pivoted relative to one another in any direction and provide a substantial degree of flexibility between the two sections of the brush assembly, permitting them to align individually with the interior walls of the tubing as they pass therethrough. This tends to enable them to do a better coating job and at the same time to reduce substantially the likelihood of being stuck in the tubing.

The two brushes illustrated in FIG. 4 are substantially identical with one another, each being made on body 38 having an opening 39 therethrough of a size to fit over and move freely along the mandrel upon which the brush is mounted in use. The brush bodies 38 are made of an outer diameter which is less than that of any expected tubing interior through which the brush is to pass, by an amount which will permit the bristles of the brush along with the body of the brush to pass through such minimum size opening.

The bristles of the brush may be mounted on the body thereof in any one of numerous ways, but a preferred way is illustrated in the forming of a spiral groove or thread 40 in the outer surface of the brush body extending substantially the entire length thereof. The bristles 11 are then laid across the threaded or groove 40 and are forced to assume a U shape and be bound into the groove with both ends of each bristle sticking outwardly in a radial direction by means of a wire or the like 42 wound into the groove from one end of the body to the other.

In order to anchor the wire or the like 42 at each end, a radially extending hole 43 may be formed from the bottom of the groove at its end toward the center of the brush body, and the end 44 of the wire bent at substantially right angles to the main length of the wire and stuck into such hole. It could then be anchored into the hole by suitable means such as a set screw 45 extending through a tapped hole from the end of the brush body into the hole 43.

Preferably each end of each of the brush bodies will be formed with a relatively thin flange-like projection 46 thereon so that it may bump against the stop provided at the lower end of the lower mandrel by the "Go-No Go" 21, by the upper end of the lower mandrel and the lower end of the upper mandrel by the parts of the knuckle joint, and at the upper end of the upper mandrel by the stop element 17. By making this part relatively thin in a radial direction the otherwise cushioning effect of the coating material between the brush body and the stop member in each case will be largely avoided.

Although the "Go-No Go" 21 is provided for the purpose of preventing the brush assembly from getting caught or stuck in a section of tubing having a stricture of smaller dimension than the brush assembly is adapted to negotiate, it is still conceivable that sticking of the brushes could occur. It is against this possiblity that the structural relationship between the mandrels and the brush bodies is provided so that the brush bodies and the mandrel may move upwardly and downwardly relative to one another to a limited degree. In the event that such a sticking of the brush should occur, a dislodging procedure will be possible by first lowering the mandrels with the attached weight until they move to their lower most positions with respect to the stuck brushes, then rapidly pulling upwardy on the mandrels through the medium of the wire line and the hoisting equipment until the stops provided by the upper knuckle joint member and the "Go-No Go" member 21 strike against the lower ends of the two brushes. Thus there will be provided a hammering or jarring effect upon the brushes tending to dislodge them from any stuck relationship in which they might be engaged.

From the foregoing it will be seen that a method of coating the interior of an elongated hollow member has been devised and provided whereby such coating may be accomplished at a much faster rate than heretofore possible, that the coating may be made smoother and more uniform, that it may be insured that the coating will cover the entire inner surface of the pipe or other member, and that the amount of material for coating may be kept to the minimum by more accurately predetermining the thickness of the coating.

It will further be apparent that the apparatus described is pecularily suitable for carrying out this method and accomplishing the desirable results stated, as well as avoiding such difficulties as becoming stuck in the member being coated, etc.

Having described my invention, what is claimed is:

1. A method of coating the inner surface of a tubular well conduit at least partially subterrainean and disposed with its longitudinal dimension having a substantial vertical component, which method comprises:

(a) placing a body of fluid coating material within and adjacent the upper extremity of said conduit in an amount sufficient to coat said inner surface, (b) lowering into said member a bristle type brush of an outer size and contour to provide complete circumferential close-bristle proximity to said surface within normally-to-be expected variations of the inner cross section of said conduit, while also providing fluid flow clearances for passage of fluid longitudinally past said brush in said conduit, (c) forcing said brush downwardly against said coating material body at a rate faster than said body would move through the conduit under influence of gravity alone, whereby a first part of said body will be forced by the brush against the inner surface of said conduit around the complete periphery of said brush, whereby to coat said entire surface as the brush moves downwardly through the conduit, while a second part of the coating material body will be forced downwardly through the conduit ahead of the brush for coating said conduit at a lower level, while a third part of said body is extruded around and past the brush and forced into the space within said conduit above the brush as the brush moves downwardly, and the brush is subsequently retracted thru said conduit from the bottom to the top to accomplish a second application of material to said surface.

2. The method set forth in claim 1 in which the bristles of the brush are partially collapsed toward the center of the brush during movement of the brush through strictures in said conduit to permit passage of the brush through strictures in said conduit not exceeding a predetermined degree of stricture, and expanded between strictures to provide close bristle proximity to inner surface of the conduit past the maximum expected internal dimensions of said conduit.

3. The method set forth in claim 1 in which a gaging part of the minimum outer dimensions through which the brush will pass without sticking is moved through said conduit in advance of said brush to detect strictures in said conduit less than the predetermined internal dimension of stricture through which said brush will pass.

4. A method set forth in claim 1 in which the downward force on the brush is supplied by a weight secured to an end of the brush assembly.

* * * * *